US005391295A

United States Patent [19]

Wilcox et al.

[11] Patent Number: 5,391,295

[45] Date of Patent: Feb. 21, 1995

[54] SPILL CONTAINMENT SYSTEM

[76] Inventors: Jack M. Wilcox, 1313 Bryan Dr., Bedford, Tex. 76022; Keith D. von Kohn, 3903 Parker Oaks Ct., Arlington, Tex. 76106

[21] Appl. No.: 127,324

[22] Filed: Sep. 27, 1993

[51] Int. Cl.[6] ..... E03F 5/14

[52] U.S. Cl. ..... 210/165; 210/170; 210/266; 210/282; 210/283

[58] Field of Search ..... 210/163, 164, 165, 166, 210/266, 282, 283, 284, 170

[56] References Cited

U.S. PATENT DOCUMENTS 1,127,246 2/1915 Hirshstein ..... 210/165
3,322,695 5/1967 Alfrey et al. ..... 210/510.1
5,215,657 6/1993 Goldfield et al. ..... 210/283

*Primary Examiner*—Ivars Cintins
*Attorney, Agent, or Firm*—Arthur F. Zobal

[57] ABSTRACT

This new containment system consisting of multiple drains in a common manifold, provides a simple but automatic closure device that requires minimum and low cost maintenance. Storm water can pass through the drains and does not require manual pumping like the present systems. Small amounts of contaminants will be absorbed as the water passes through the drain ensuring the storm water leaving the containment area is free of contaminants. The system is custom designed for each installation and each potential contaminant, making it very adaptable.

12 Claims, 7 Drawing Sheets

SPILL CONTAINMENT SYSTEM

BACKGROUND OF THE INVENTION

The containment of oil and other organic liquids spills is an ever growing problem that will continue to enlarge with increasing environmental concerns. By building a containment area around the equipment or tank containing the contaminant, a spill would be confined to the area inside the containment area. One of the problems with this concept is that the containment area is outdoors where it is subject to rainfall and dirt or other foreign particles. This invention is a system that will solve these and other problems.

SUMMARY OF THE INVENTION

It is an object of this invention to provide a new and useful drain for preventing spills from escaping the containment site while allowing rain water to pass through this drain.

It is a further object of the invention to use a plurality of the drains in a manifold system.

DETAILED DESCRIPTION OF THE INVENTION

Figure 1:
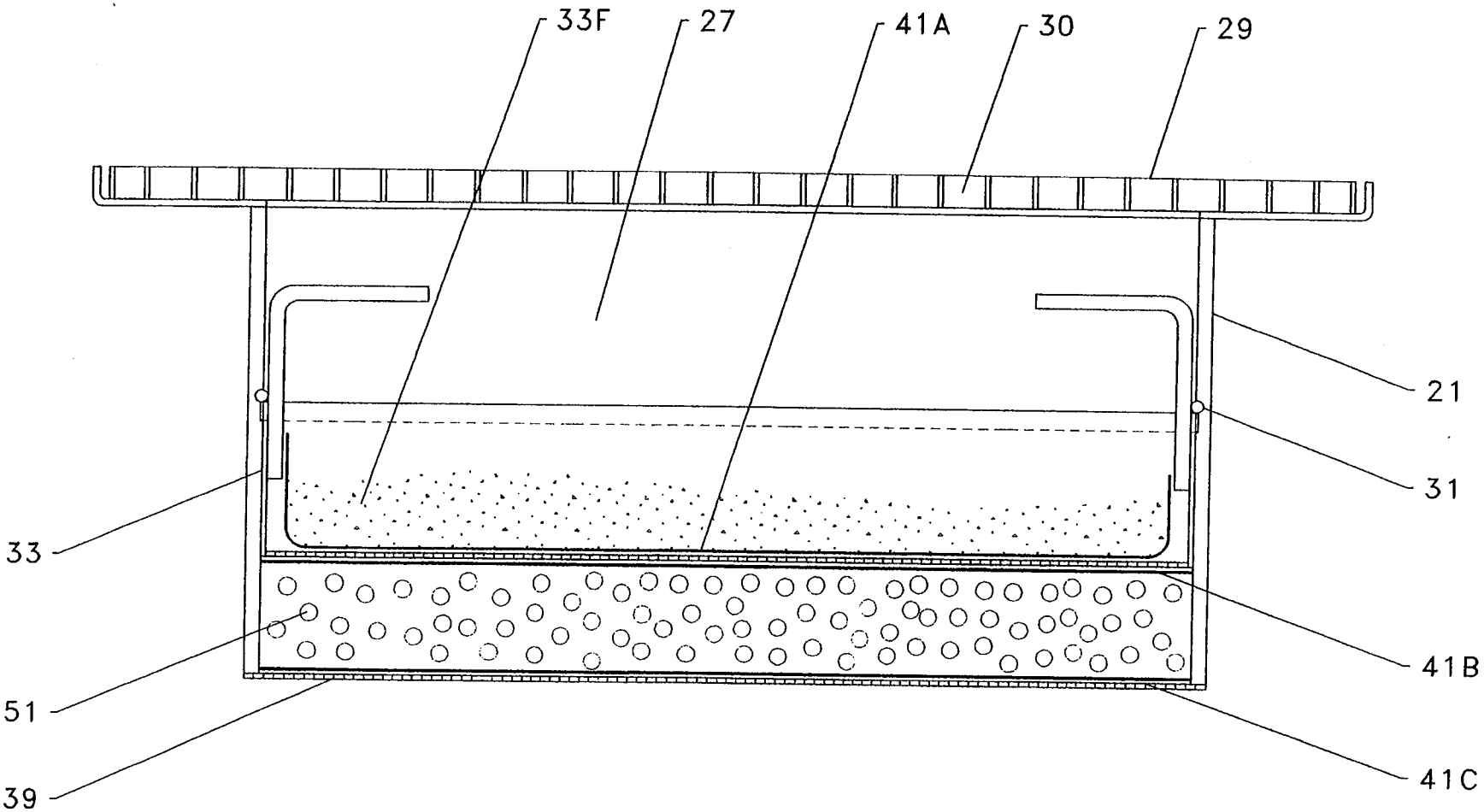
FIG. 1 is a cross-sectional side view of the drain of the invention.
Figure 2:
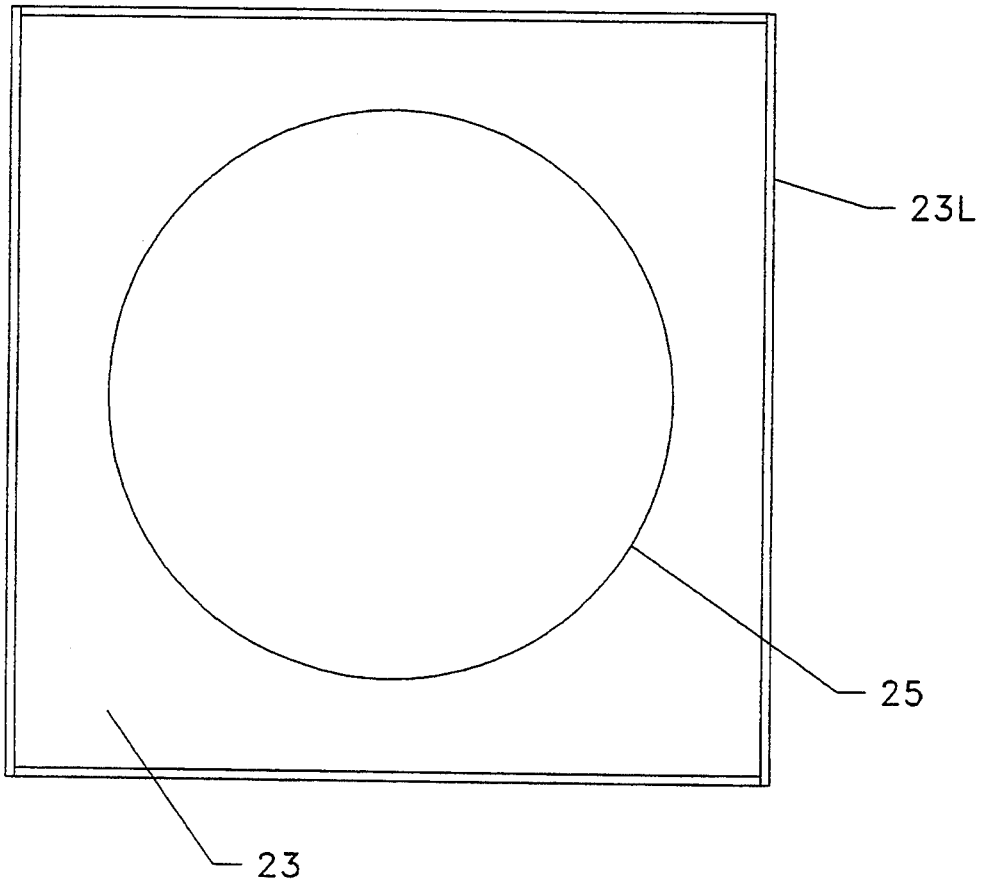
FIG. 2 is a top plan view of the drain of FIG. 1 with the grating removed.
Figure 3:
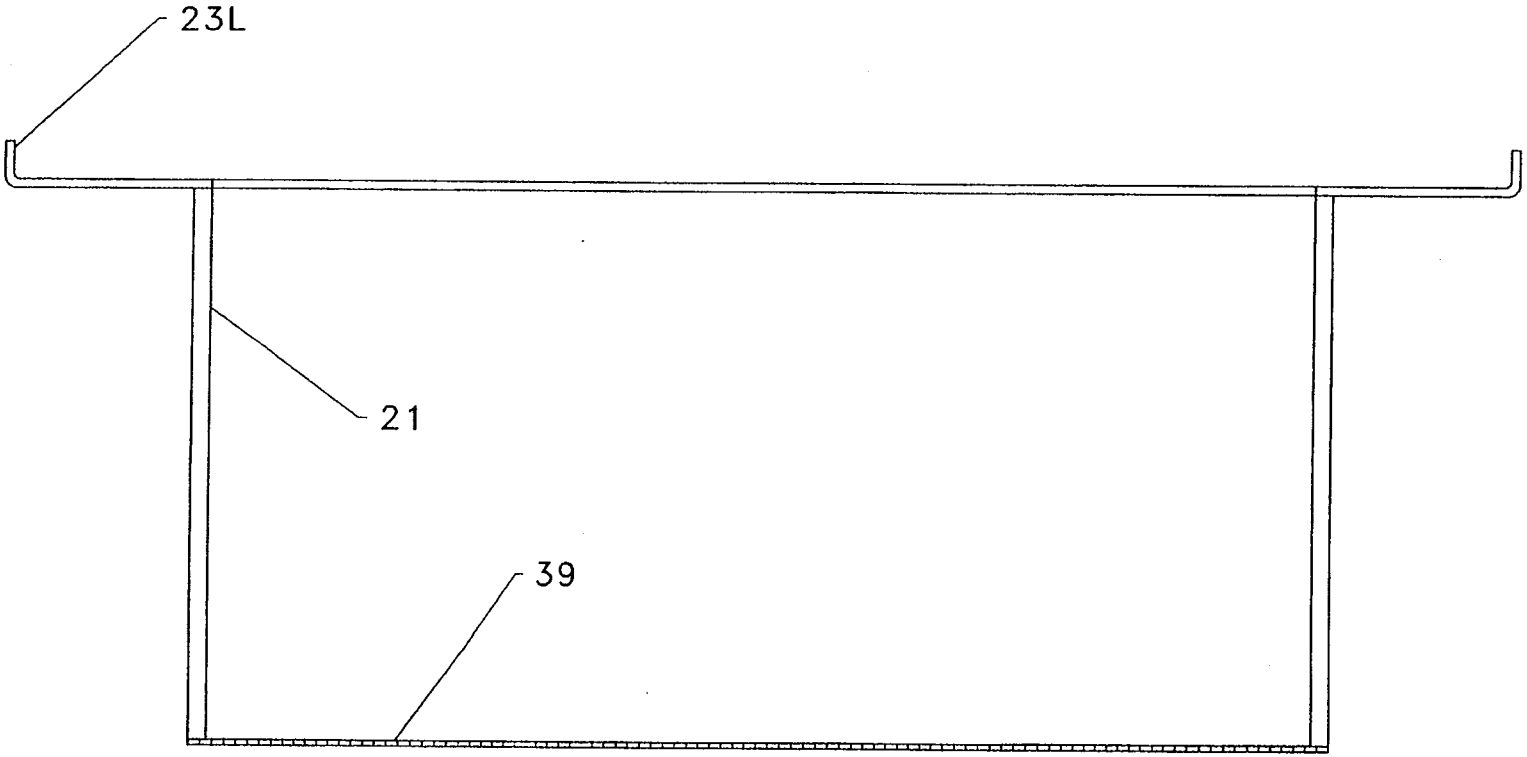
FIG. 3 is a cross-sectional side view of the housing of the drain.
Figure 4:
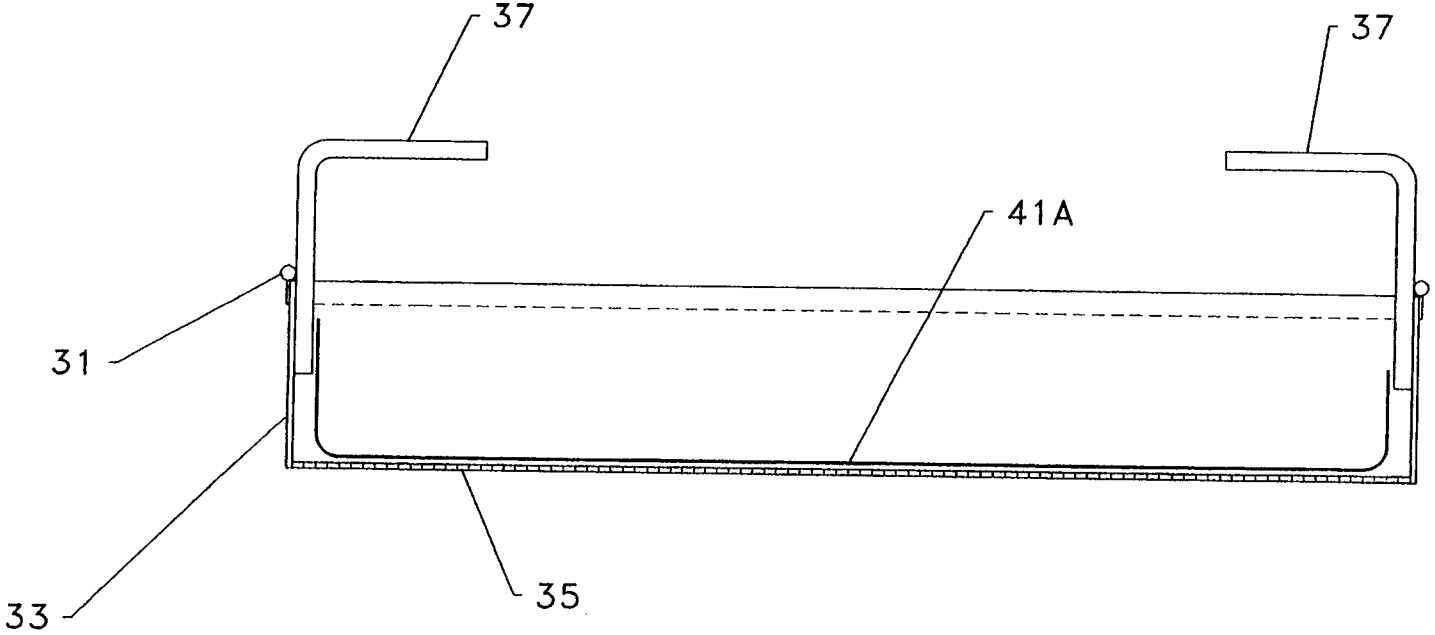
FIG. 4 is a cross-sectional side view of the filter basket of the drain.
Figure 5:
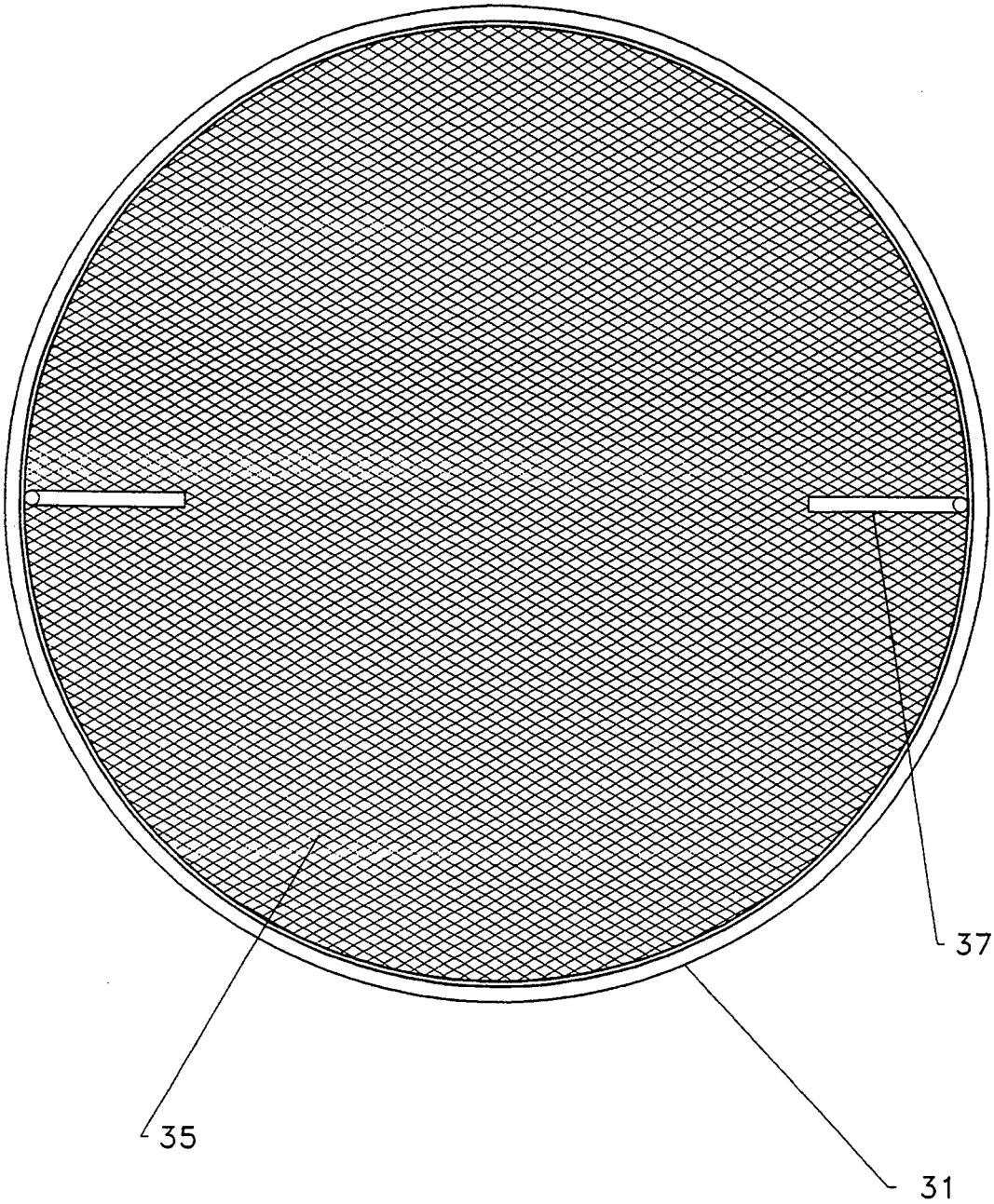
FIG. 5 is a top plan view of the filter basket.

Referring now to FIGS. 1–5, the drain comprises a cylindrical metal wall 21 having a square metal top 23 welded to the top edge of the wall 21. The top 23 has a circular opening 25 formed therethrough in alignment with the central opening 27 of the housing 21. A lip 23L extends upward from the edges of the top 23 and removably holds a galvanized trash grating 29 having opening 30 formed therethrough. A typical housing is formed of one quarter inch thick galvanized metal pipe having an inside diameter of 24 inches. A ring shaped gasket 31 is installed between the inside wall of the housing and the outside wall of the removable cylindrical basket 33. The side wall of the filter basket 33 is typically constructed of 14 gauge sheet metal molded to the proper size and it has an expanded metal bottom 35 (having openings formed therethrough) welded at its bottom on the inside. Two one half inch diameter bent rods 37 are welded to the inside of the filter basket for use as handles. After construction the filter basket is hot dipped galvanized. Layers of geotextile material 41A and 41B are located on top of the expanded metal 35 and below the filter basket 33. This geotextile is a non-woven polyester needle punched engineered fabric manufactured by Hoechst Celenese Corporation and sold under the trademark TREVIRA SPUNBOND ®. An expanded metal bottom 39 is welded to the bottom of the housing 21. The bottom 39 (having openings formed therethrough) is the same as the bottom 35. The bottom 39 is galvanized and cold tar epoxy is sprayed over the galvanized finish to give it extra protection. The expanded metal 35 welded to the filter basket has the same coating. A layer of the geotextile material 41C is located on the top of the bottom 39. The geotextile material layers 41A, 41B and 41C allow water to flow therethrough.

Before the filter basket is inserted in place, the housing 21 is partially filled with hydrophobic swellable polymer granules 51 of the type disclosed in U.S. Pat. No. 3,322,695. The beads have a size between 300 and 500 microns. The layer 41B is then located on top of the beads 51 and the basket 33 inserted in the housing to rest on the beads 51 and layer 41B. The basket 33 is filled with a filter material 33F such as sand.

In one embodiment, the geotextile layers having the following properties:

1. Fabric Weight of 4.2 ounces per square yard.
2. Thickness of 70 mils.
3. Puncture Resistance of 65 pounds.
4. Mullen Burst Strength of 225 pounds per square inch.
5. Water Flow Rate of 190 gallons per minute per square foot.
6. Permeability of 0.45 centimeters per second.
7. Sieve size 0.210–0.149 millimeters.

Figure 6:
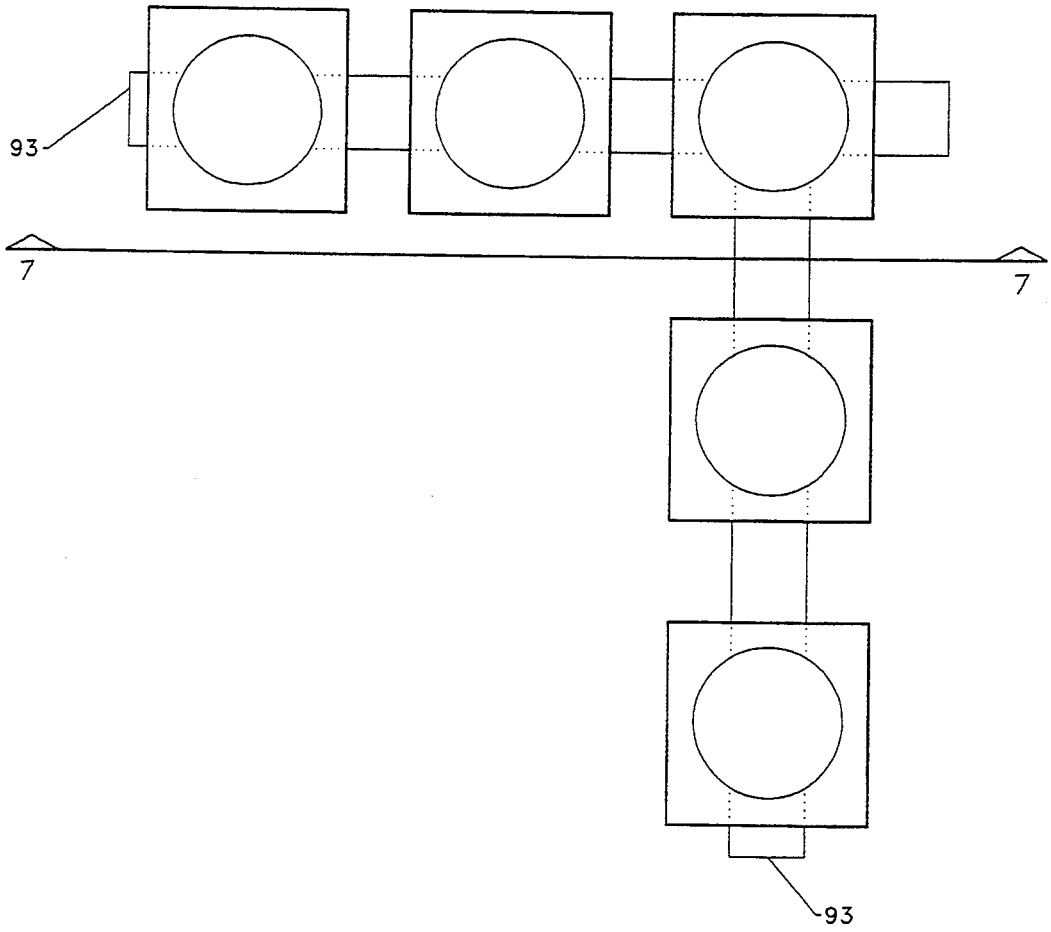
FIG. 6 is a plan view of a manifold system incorporating a plurality of the drains of FIG. 1.
Figure 7:
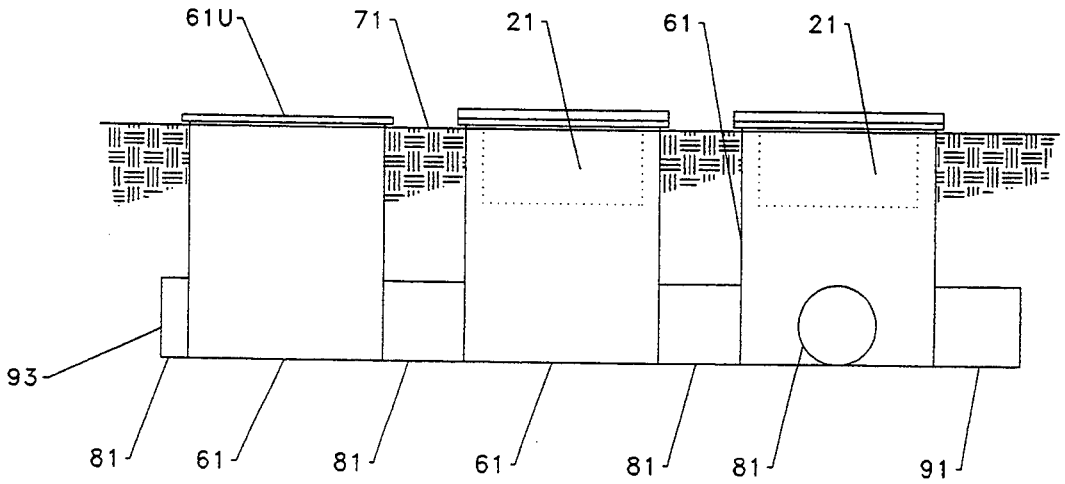
FIG. 7 is a side view of the system of FIG. 6 as seen along lines 7—7 thereof.

Referring to FIGS. 6 and 7, the manifold system comprises a plurality of hollow cylindrical drain holders 61 located in the ground 71 with pipes 81 connecting the holders 71 together leading to an outlet pipe 91. Each of the holders 61 supports a drain 21 on its upper edge 61 with the drain extending into the holder. In FIG. 7, a drain is shown in dotted form supported by one of the holders. Members 93 are removable caps. In summary the manifold system is comprised of multiple drains connected within a manifold with one common outlet.

The drains consist of several elements. The housing is characteristically a 1 foot deep section of 24 inch diameter galvanized metal pipe with a 32 inch square top welded on top of the pipe and cut out to maintain the 24 inch opening. The 32 inch square top provides a surface to support the drain on top of the manifold. The top of the housing is raised to hold a piece of removable grating sufficiently strong to support a large person's weight. This grating will keep large debris from infiltrating the drain. The housing can be made of several different materials. The bottom is constructed of expanded metal with openings in one embodiment no larger than one quarter of an inch square. Inside the housing different components are installed. Beginning at the bottom, a geotextile fabric is caulked on top of the expanded metal using fifty year caulk, caulking only where the expanded metal and the housing connect to minimize the area restricting flow. On top of the fabric a layer of hydrophobic swellable polymer material with an indefinite shelf life is installed. The polymer will not absorb water and will let the water drain through. The polymer will however react with organic liquids and swell sufficiently to discontinue the flow of any liquid through the drain. The depth of the material is dependent on the characteristics of the reaction between the polymer and the particular contaminant being contained. Each liquid must be tested to determine the depth of polymer required to seal the system. Above the polymer material another layer of geotextile material is placed to help ensure the integrity of the polymer. A removable filter basket is placed next. This is an integral part of the design for more than one reason. It provides weight on top of the polymer to force it to swell outward instead of upward and it traps dirt and other small particles that would clog the polymer material and stop or reduce the flow through the drain. Another feature of the filter basket is should the contaminate catch on fire the filter material would keep the fire from burning through the drain. The radius of the basket is constructed approximately one quarter of an inch smaller than the housing to allow for removal. The height of the basket is designed to allow three inches of filter material, typically sand. The bottom of the filter basket is also constructed of expanded metal with openings, in embodiment of, no larger than one quarter inch square to provide maximum flow rate through the filter material. A layer of geotextile material is placed on top of the expanded metal in the filter basket to ensure the filter material remains separate from the polymer material. The filter material is then placed on the fabric. The complete filter basket can easily be removed using the built in handles to replace the filter material or check the integrity of the material below. A gasket is then placed between the filter basket and the housing to eliminate the contamination of the polymer material below.

Once the components have been installed in the housing, the drain can then be inserted into an opening of the manifold. The opening is several inches larger in radius than the drain for easy installation. The manifold has a flange on top of the opening that matches the square top of the drain to provide a large surface to seal the drain to the manifold to ensure the liquid goes through the drain not around it. Butyl caulk is placed on top of the manifold flange before the drain is placed in the opening to seal it. This establishes a good seal, but, if necessary, does allow a way to remove the drain for replacement or inspection. The depth of the manifold is site dependant due to the surrounding elevations. The connecting outlet pipe is sized according to the number of drains installed. The outlet pipe can be constructed of different materials according to the depth and load bearing requirements.

In this system a manifold with a predetermined number of drain openings is installed in the containment area at the lowest elevation to create a gravity drain. The number of drain openings are calculated to dissipate the rainfall from the area according to a specified flow rate which is also site dependent. Storm water runoff will pass through the sand filter and geotextile and then through the polymer material and finally out the bottom of the drain into the manifold system continuing through the outlet pipe. If a spill occurs, the contaminant will flow to the drains, react with the polymer causing the polymer to swell and seal the drains. This will cause the contaminant to pond around the area where the drains are installed until the contaminant can be removed and disposed of properly. No liquid will be able to pass through the drain until the reacted polymer material is removed and replaced with new uncontaminated material. If a spill occurs during a rainstorm then any water standing prior to the spill will drain until the contaminated water causes the drain to seal.

Some examples of where this system could be used but not limited to these are:

In a containment area surrounding an electric company power transformer filled with insulating oil.

In a diked area surrounding a crude oil storage tank.

In a containment area around gasoline or jet fuel tanks.

We claim:

1. A drain comprising,

A housing having upper and lower ends with an opening formed therethrough, said upper end of said housing forming an inlet to said drain and said lower end of said housing forming an outlet of said drain, A grating secured across the lower end of the housing, A lower layer of material porous to water located on the upper side of the grating, A layer of hydrophobic swellable polymer particles located on said lower layer of material, said lower layer of material being employed for holding said hydrophobic swellable polymer particles in said housing, An intermediate layer of material porous to water located on the upper surface of the hydrophobic swellable polymer particles, said intermediate layer of material being employed for protecting said hydrophobic swellable polymer particles, A removable basket located on said intermediate layer, said basket having upper and lower ends with an opening extending therethrough, A basket grating secured across the lower end of said basket, An upper layer of material porous to water located on said grating of said basket, and A filter of granular material located in said basket on said upper layer of material, said upper layer of material being employed for holding said filter of granular material in said basket, said hydrophobic swellable polymer particles being characterized in that said particles swell upon reaction with organic liquids to block liquid flow through said drain upon contact with organic liquids.

2. The drain of claim 1, wherein:

said housing has a given height between said upper and lower ends of said housing with said opening of said housing having about the same cross-sectional size along said given height of said housing.

3. The drain of claim 2, comprising:

a drain holder located in the ground and having an opening leading to a lower passageway, said drain holder having an upper end at about the level of the ground, said drain being located in said opening of said drain holder with said upper end of said drain facing upward.

4. The drain of claim 1, comprising:

a drain holder located in the ground and having an opening leading to a lower passageway, said drain holder having an upper end at about the level of the ground, said drain being located in said opening of said drain holder with said upper end of said drain facing upward.

5. A drain comprising:

a housing having upper and lower ends with an opening formed therethrough, said upper end of said housing forming an inlet to said drain and said lower end of said housing forming an outlet of said drain, a grating secured across the lower end of said housing, a layer of hydrophobic swellable polymer particles located above said grating, lower means porous to water located between said grating and said layer of hydrophobic swellable polymer particles for holding said hydrophobic swellable polymer particles in said housing, a removeable basket located above said layer of hydrophobic swellable polymer particles, said basket having upper and lower ends with an opening extending therethrough, a basket grating secured across the lower end of said basket, and a filter located in said basket, said hydrophobic swellable polymer particles being characterized in that said particles swell upon reaction with organic liquids to block liquid flow through said drain upon contact with organic liquids.

6. The drain of claim 5, comprising:

a drain holder located in the ground and having an opening leading to a lower passageway, said drain holder having an upper end at about the level of the ground, said drain being located in said opening of said drain holder with said upper end of said drain facing upward.

7. The drain of claim 6, wherein:

said filter comprises granular filter material located in the basket, and means porous to water located between said granular filter material and said basket grating for holding said granular filter material.

8. The drain of claim 5, wherein:

said housing has a given height between said upper and lower ends with said opening of said housing having about the same cross-sectional size along said given height of said housing.

9. The drain of claim 8, comprising:

a drain holder located in the ground and having an opening leading to a lower passageway, said drain holder having an upper end at about the level of the ground, said drain being located in said opening of said drain holder with said upper end of said drain facing upward.

10. The drain of claim 9, wherein:

said filter comprises granular filter material located in said basket, and means porous to water located between said granular material and said basket grating for holding said granular filter material.

11. The drain of claim 7, wherein:

said filter comprises granular filter material located in said basket, and means porous to water located between said granular material and said basket grating for holding said granular filter material.

12. The drain of claim 5, wherein:

said filter comprises particles forming a filter material located in said basket, and means porous to water located between said filter material and said basket grating for holding said filter material.

* * * * *